US010194748B1

(12) United States Patent
Baker

(10) Patent No.: US 10,194,748 B1
(45) Date of Patent: Feb. 5, 2019

(54) COMPRESSIBLE SITTING STOOL

(71) Applicant: Joseph Anthony Baker, Nashville, TN (US)

(72) Inventor: Joseph Anthony Baker, Nashville, TN (US)

( * ) Notice: Subject to any disclaimer, the term of this patent is extended or adjusted under 35 U.S.C. 154(b) by 0 days.

(21) Appl. No.: 15/624,688

(22) Filed: Jun. 15, 2017

Related U.S. Application Data

(60) Provisional application No. 62/354,412, filed on Jun. 24, 2016.

(51) Int. Cl.

| | |
|---|---|
| ***A47C 1/00*** | (2006.01) |
| ***A47C 3/00*** | (2006.01) |
| ***A47C 7/00*** | (2006.01) |
| ***A47C 9/00*** | (2006.01) |
| ***A47C 23/00*** | (2006.01) |
| ***A47C 7/14*** | (2006.01) |

(52) U.S. Cl.
CPC ..... *A47C 3/00* (2013.01); *A47C 1/00* (2013.01); *A47C 7/002* (2013.01); *A47C 7/144* (2018.08); *A47C 23/002* (2013.01); *A47C 9/00* (2013.01)

(58) Field of Classification Search
CPC .... A47C 1/00; A47C 3/00; A47C 3/16; A47C 3/20; A47C 7/002; A47C 7/022; A47C 7/14; A47C 7/34; A47C 9/00; A47C 23/04; A47C 23/002; A47C 7/144; A61G 7/0573
USPC ..... 297/284.3, 461, 462
See application file for complete search history.

(56) References Cited

U.S. PATENT DOCUMENTS

| | | | | | |
|---|---|---|---|---|---|
| 97,579 | A * | 12/1869 | Wittram | A47C 9/00 297/461 |
| 5,446,933 | A * | 9/1995 | Gabelhouse | A47C 23/002 5/670 |
| 5,523,040 | A * | 6/1996 | Krouskop | A47C 23/002 264/163 |
| 6,217,121 | B1 * | 4/2001 | Mollet | A47C 23/002 297/452.21 |
| 7,520,011 | B1 * | 4/2009 | Liberkowski | A47C 23/002 5/719 |
| D670,092 | S * | 11/2012 | Daigre | D6/349 |
| D671,758 | S * | 12/2012 | Daigre | D6/349 |
| D675,835 | S * | 2/2013 | Daigre | D6/349 |
| 8,375,492 | B2 * | 2/2013 | Hsu | A47C 23/0435 5/690 |
| 9,314,109 | B2 * | 4/2016 | Saunders | A47C 27/06 |

(Continued)

FOREIGN PATENT DOCUMENTS

| | | | | |
|---|---|---|---|---|
| CH | 708898 | A2 * | 5/2015 | A47C 23/002 |
| DE | 4405595 | A1 * | 7/1994 | A47C 7/46 |

(Continued)

OTHER PUBLICATIONS

Machine trnslation of EP2798978, May 11, 2018; http://translationportal.epo.org/emtp/translate/?ACTION=description-retrieval&COUNTRY=EP&ENGINE=google&FORMAT=docdb&KIND=A1&LOCALE=en_EP&NUMBER=2798978&OPS=ops.epo.org/3.2&SRCLANG=de&TRGLANG=en (Year: 2018).*

*Primary Examiner* — Ryan D Kwiecinski
(74) *Attorney, Agent, or Firm* — Shane Cortesi

(57) ABSTRACT

The present invention relates to a compressible sitting stool. The stool may include a housing, a compressible layer located in the housing interior, and a plurality of dowels located above the compressible layer. The tops of the plurality of dowels create a sitting area and when a user sits (Continued)

on the sitting area, the dowels move downwards compressing the compressible material.

13 Claims, 6 Drawing Sheets

(56) References Cited

U.S. PATENT DOCUMENTS

| | | | | |
|---|---|---|---|---|
| 9,955,795 | B2 * | 5/2018 | Krenik | A47C 23/06 |
| 2003/0172456 | A1 * | 9/2003 | Jones | A47C 19/005 5/200.1 |
| 2014/0137337 | A1 * | 5/2014 | DeFranks | A47C 27/06 5/723 |
| 2015/0359340 | A1 * | 12/2015 | George, II | A47C 5/12 297/228.1 |

FOREIGN PATENT DOCUMENTS

| | | | | |
|---|---|---|---|---|
| EP | 2798978 | B1 * | 1/2016 | A47C 7/025 |
| GB | 320877 | A * | 10/1929 | A47C 7/34 |

* cited by examiner

COMPRESSIBLE SITTING STOOL

RELATED APPLICATIONS

This application claims priority under 35 USC 119 to Application No. 62/354,412, filed Jun. 24, 2016 and entitled "Compressible Sitting Stool", the contents of which are incorporated herein by reference in their entirety.

BACKGROUND

Technical Field

The present invention relates to furniture items, more particularly to stools for sitting.

Background of the Invention

Stools have been around for centuries. Stools, at least in Western countries, typically include a seat without a back and a base or three or four legs. For example, an ornamental design for a stool is shown in U.S. Design Pat. No. D746,073. Another stool design is shown in U.S. Design Pat. D579677.

Unfortunately, such conventional stools are often uncomfortable and look out of place in a modern house.

Thus, there is a need for stools that are comfortable and aesthetic.

BRIEF SUMMARY

The present disclosure provides a compressible sitting stool. In some embodiments, the compressible sitting stool includes: a) a housing comprising an interior, a bottom, a top, a height extending from the bottom to the top, and a width generally perpendicular to the height; b) a compressible layer disposed in the housing interior (optionally above the housing bottom), the compressible layer having a compressible layer height generally parallel to the housing height and a compressible layer width generally parallel to the housing width; and c) a plurality of dowels located above the compressible layer, each dowel comprising a dowel bottom facing the compressible layer, a dowel top located above the dowel bottom, a dowel height extending from the dowel bottom to the dowel top and generally parallel to the housing height, and a dowel width generally parallel to the housing width.

Optionally, the tops of the plurality of dowels form a sitting area. Optionally, the compressible sitting stool has a relaxed state in which the dowels do not compress the compressible material and a compressed state in which the sitting area is lower as compared to the relaxed state, in which the dowels compress at least a portion of the compressible layer and in which the dowel bottoms are closer to the housing bottom as compared to the relaxed state. Optionally, the height of at least a portion of the compressible layer is less in the compressed state as compared to the relaxed state. Optionally, the compressible sitting stool is configured to move from the relaxed state to the compressed state when a human sits on the sitting area.

Optionally, the dowels are rigid. Optionally, the compressible sitting stool further comprises a base located in the housing interior above the housing bottom, the base located below and supporting the compressible layer. Optionally, the base is in the form of a lattice. Optionally, the base extends across substantially the entire width of the housing. Optionally, the dowels, the sitting area and the housing are generally rectangular. Optionally, the compressible layer comprises at least one spring. Optionally, the compressible layer comprises the same number of springs as the compressible sitting stool comprises dowels, and further wherein each spring is attached to a dowel bottom. Optionally, the dowels are not attached to each other. Optionally, the compressible sitting stool further comprises a base located in the housing interior (optionally above the housing bottom), the base located below and supporting the compressible layer, wherein the compressible layer comprises at least one spring, and further wherein the at least one spring is attached to the base and a dowel. Optionally, the base is in the form of a lattice. Optionally, the heights of the dowels are substantially the same in the relaxed state. Optionally, each dowel is comprised of wood. Optionally, the tops of the plurality of dowels forms a substantially continuous sitting area. Optionally, the bottom of each dowel rests on the compressible layer. Optionally, the compressible layer extends substantially across the entire width of the housing. Optionally, the compressible layer is in the form of a rectangular piece of foam. Optionally, the foam is an open-cell upholstery foam. Optionally, the housing is generally rectangular in shape and is comprised of four opaque walls extending from the housing bottom.

Optionally, the present disclosure provides a method of using the compressible sitting stool, comprising: a) providing the compressible sitting stool, wherein the housing bottom is located on a surface and wherein the compressible sitting stool is in the relaxed state; and b) sitting on the sitting area so that the compressible sitting stool moves toward the compressed state.

BRIEF DESCRIPTION OF THE DRAWINGS

in FIG. 1, the housing side walls are partially cut away to show the parts.

in FIG. 2, the housing side walls are partially cut-away to show the parts and the compressible sitting stool is in the relaxed state.

in FIG. 3, the housing side walls are partially cut-away to show the parts and the compressible sitting stool is in the relaxed state.

in FIG. 4, the housing side walls are partially cut-away to show the parts.

in FIG. 5, the housing side walls are partially cut-away to show the parts.

in FIG. 6, the compressible sitting stool is in the relaxed state.

in FIG. 7, the compressible sitting stool is in the relaxed state.

in FIG. 8, the compressible sitting stool is moving from the relaxed state toward the compressed state due to a user sitting on the sitting area.

in FIG. 9, the compressible sitting stool is moving from the relaxed state toward the compressed state due to a user's hand being placed on the sitting area.

in FIG. 10, the dowels and the compressible layer are removed to show the base/lattice.

in FIG. 11, the housing side walls are partially cut-away to show the parts and the compressible sitting stool is in the relaxed state.

in FIG. 12, the housing side walls are partially cut-away to show the parts and the compressible sitting stool is in the relaxed state.

in FIG. 18, the housing side walls are partially cut-away to show the parts and the compressible sitting stool has moved toward the compressed state.

DETAILED DESCRIPTION

Figure 1:
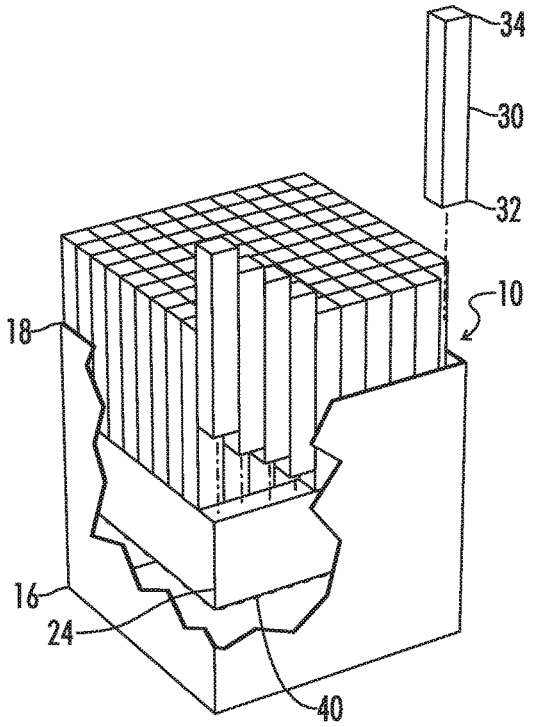
FIG. 1 illustrates a partially exploded isometric view of a compressible sitting stool of one embodiment of the present invention.
Figure 2:
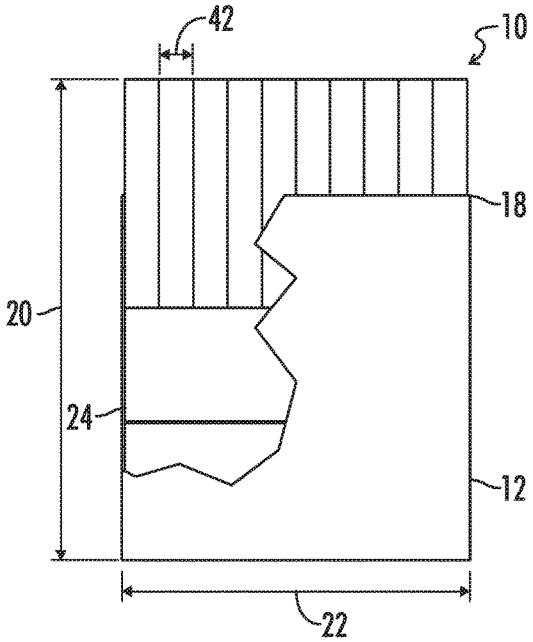
FIG. 2 illustrates a side assembled elevation view of the compressible sitting stool of FIG. 1.
Figure 3:
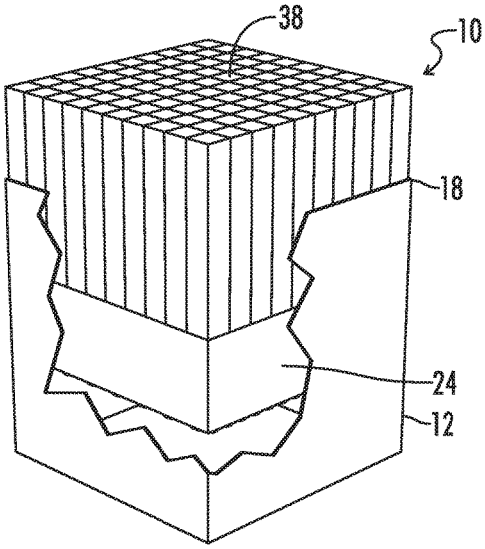
FIG. 3 illustrates an assembled isometric view of the compressible sitting stool of FIG. 1.

With reference to FIGS. 1-18, the present invention provides a compressible sitting stool for sitting generally designated by the numeral 10. In the drawings, not all reference numbers are included in each drawing for the sake of clarity.

Referring further to FIGS. 1-18, in some embodiments, the compressible sitting stool 10 includes: a) a housing 12 comprising an interior 14, a bottom 16, a top 18, a height 20 extending from the bottom 16 to the top 18, and a width 22 generally perpendicular to the height 20; b) a compressible layer 24 disposed in the housing interior 14 above the housing bottom 16, the compressible layer 24 comprising a height 26 generally parallel to the housing height 20 and a width 28 generally parallel to the housing width 22; c) a plurality of dowels/rods 30 located above the compressible layer 24, and each dowel 30 comprising a bottom 32 facing the compressible layer 24, a top 34 located above the dowel bottom 32, a height 36 extending from the dowel bottom 32 to the dowel top 34 and generally parallel to the housing height 20, and a dowel width 42 generally parallel to the housing width 22, the tops 34 of the plurality of dowels 30 forming a sitting area 38. The compressible sitting stool 10 has a relaxed state in which the dowels 30 do not compress the compressible layer 24, and a compressed state in which the sitting area 38 is lower as compared to the relaxed state, in which the dowels 30 compress at least a portion of the compressible layer 24 so that at least a portion of the compressible layer height is lower in the compressed state than the relaxed state, and in which the dowel bottoms 32 are closer to the housing bottom 16 as compared to the relaxed state. The dowel height 36, which is generally greater than the dowel width 42, may be for example from about four inches to about nine inches. However, it will be understood that such dimensions are merely exemplary. Preferably, the dowels 30 are substantially the same size and shape. Preferably, at least the widths 42 of each dowels 30 is substantially the same. The compressible sitting stool 10 moves from the relaxed state toward the compressed state when an object or person sits on the sitting area 38, as shown in FIGS. 8 and 9. Preferably, the compressible layer 24 is elastic so that the compressible layer 24 returns to its original position (i.e., the compressible sitting stool 10 returns to the relaxed state) when the object or person leaves the sitting area 38. Preferably, the dowels 30 are generally straight and have a smooth top 34 so that they are comfortable. Preferably, the tops 34 of the plurality of dowels 30 form a substantially continuous sitting area 38, as best seen in FIGS. 3-7 and 11-12. In other words, the size of any gaps 41 between the dowels 30 is between 0.0001 inches to about 0.25 inches.

Figure 18:
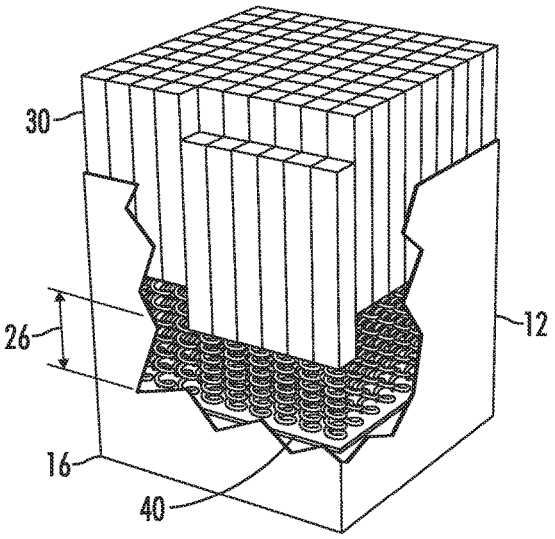
FIG. 18 illustrates an isometric view of the compressible sitting stool of FIG. 11.

Preferably, the dowels 30 are not attached to one another. Preferably, the dowels 30 are rigid and do not themselves compress when a human 52 sits on the sitting area 38. For example, the dowels 30 may be comprised of a material that is harder than the material forming the compressible layer 24. For example, the dowels 30 may be comprised of wood or plastic and the compressible material may be foam, which may be upholstered or otherwise covered to protect the dowels 30 from damaging the foam. Optionally, the foam is an open-cell upholstery foam. Preferably, the foam is the same shape as the housing 12. For example, if the housing 12 is rectangular, preferably, the foam is also rectangular. Additionally, if the housing 12 is circular in shape, preferably the foam is also circular. Likewise, if the housing 12 is in the shape of an oval, preferably, the foam is in the shape of an oval. Optionally, the bottom 32 of each dowel 30 rests on the compressible layer 24. As shown in FIGS. 11-18, the compressible layer 24 may be comprised of a plurality of coil springs. For example, the compressible sitting stool 10 may have the same number of springs as dowels 30, as shown in FIGS. 11-18, in which case, a spring may be located below, and preferably attached to, each dowel 30. FIGS. 13-18 show various ways in which a spring may be attached to the dowel bottom 32 via a fastener 56. The spring may include a spring top 46 confronting the dowel bottom 32, a spring bottom 48, a spring height 50 and the spring height 50 is less in the compressed state as compared to the relaxed state, as shown in FIG. 18. As opposed to coil springs, the compressible layer 24 may be comprised of gas springs or any other suitable spring.

Figure 7:
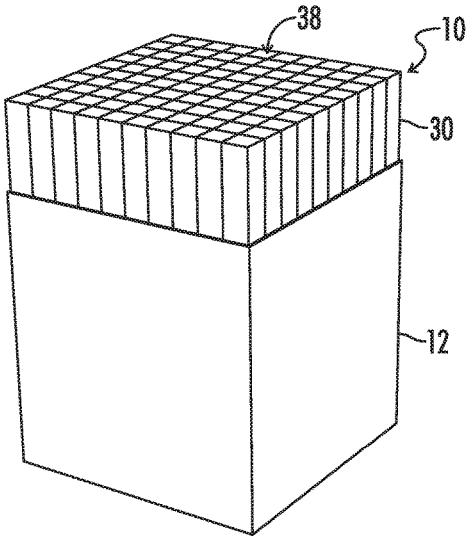
FIG. 7 illustrates an isometric compressible sitting stool of FIG. 1.
Figure 8:
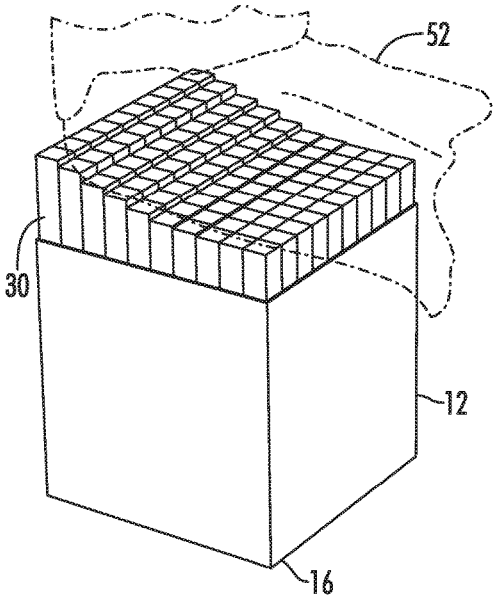
FIG. 8 illustrates an isometric view of the compressible sitting stool of FIG. 1.
Figure 9:
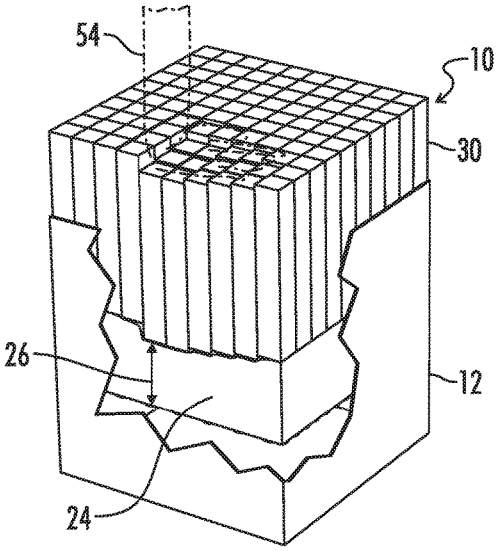
FIG. 9 illustrates an isometric view of the compressible sitting stool of FIG. 1.

The housing 12 may be any suitable shape, include rectangular as shown in FIGS. 1-12. If the housing 12 is rectangular in shape, each dowel 30 may also be generally rectangular in shape and the sitting area 38 may also be generally rectangular in shape. Optionally, the housing 12 is generally rectangular in shape and is comprised of four opaque walls extending from the housing bottom 16, as best seen in FIGS. 7-8. Optionally, the housing interior 14 has substantially the same width and length as the combined length and width of the plurality of dowels 30, as best seen in FIGS. 1, 3, and 7-9, 11 and 18, so that the dowels 30 do not shift back and forth and the dowel heights 36 remain parallel to the housing height 20 when the compressible sitting stool 10 moves between the relaxed state and the compressed state.

Preferably, each dowel 30 has substantially the same height 36 (i.e., each dowel 30 is the same length) and the top 44 of the compressible layer 24 is generally flat so that the sitting area 38 is generally flat in the relaxed state, as best seen in FIGS. 2, 3, 5, 7, 11, and 12 for example.

Figure 4:
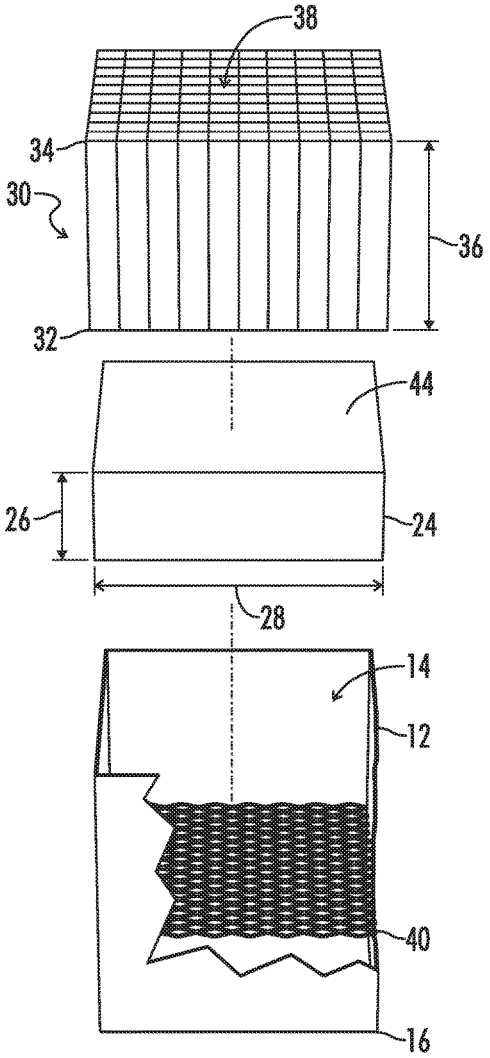
FIG. 4 illustrates a side perspective view of the compressible sitting stool of FIG. 1.
Figure 5:
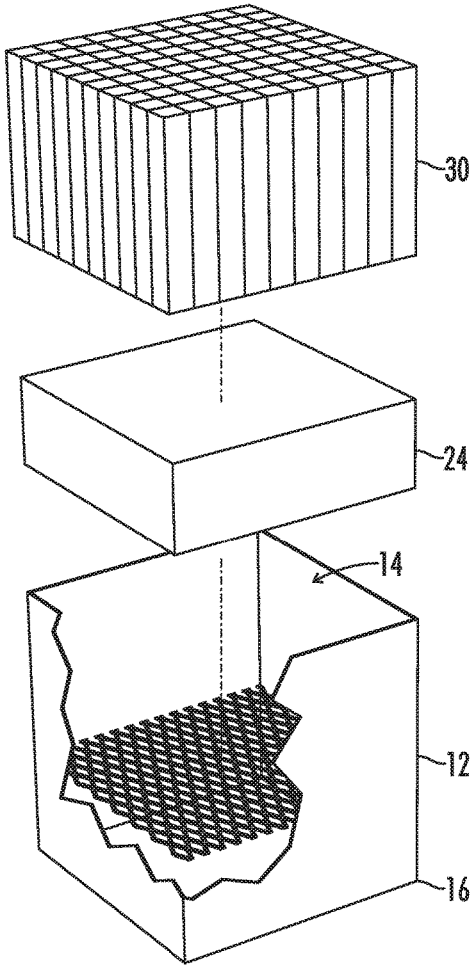
FIG. 5 illustrates another exploded isometric view of the compressible sitting stool of FIG. 1.
Figure 6:
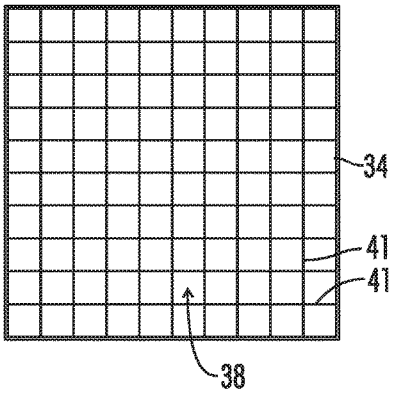
FIG. 6 illustrates a top plan view of the compressible sitting stool of FIG. 1.
Figure 10:
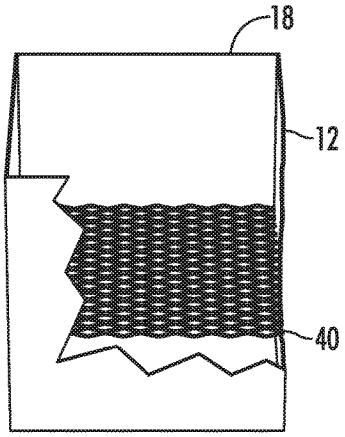
FIG. 10 illustrates a top perspective view of the compressible sitting stool of FIG. 1.
Figure 11:
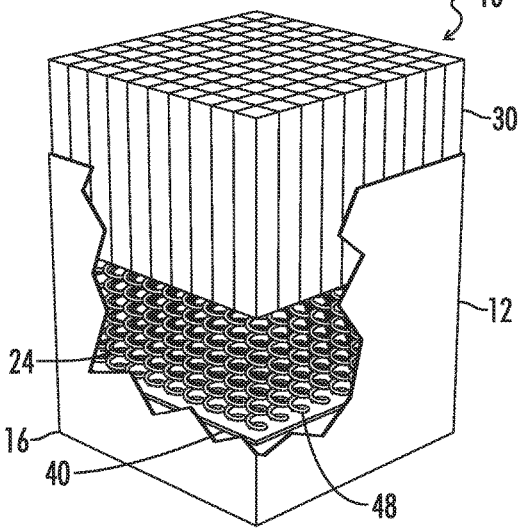
FIG. 11 illustrates an isometric view of a compressible sitting stool of another embodiment of the present invention.
Figure 12:
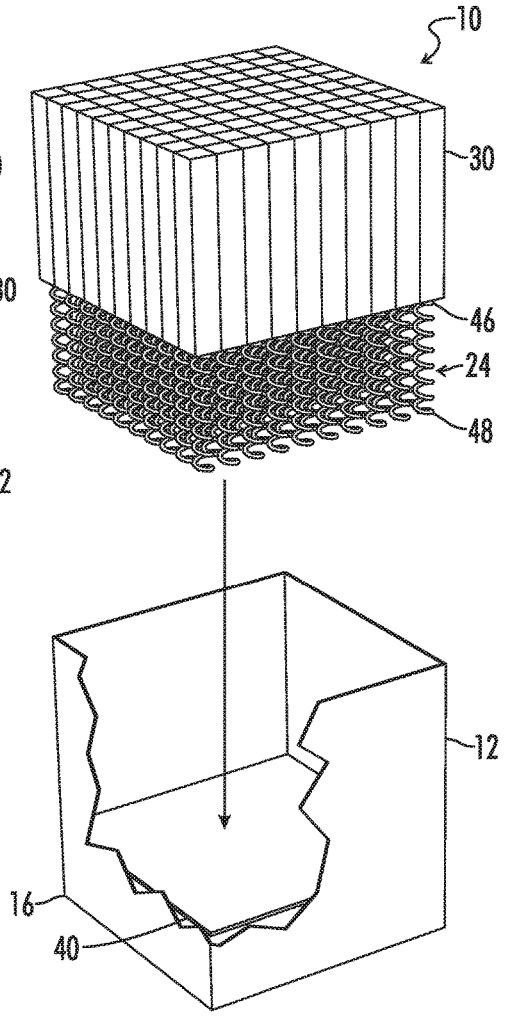
FIG. 12 illustrates an isometric partially exploded view of the compressible sitting stool of FIG. 11.
Figure 13:
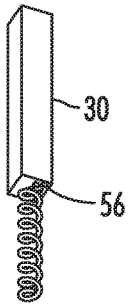
FIG. 13 illustrates an isometric view of a spring attached to a dowel for use in conjunction with the compressible sitting stool of one embodiment of the present invention.
Figure 14:
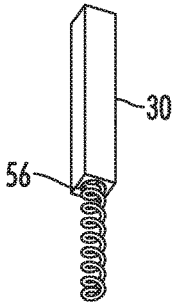
FIG. 14 illustrates an isometric view of a spring attached to a dowel for use in conjunction with the compressible sitting stool of one embodiment of the present invention.
Figure 15:
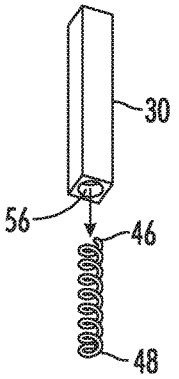
FIG. 15 illustrates an exploded isometric view of the spring attachment mechanism shown in FIG. 14.
Figure 16:
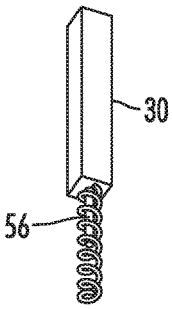
FIG. 16 illustrates an isometric view of a spring attached to a dowel for use in conjunction with the compressible sitting stool of one embodiment of the present invention.
Figure 17:
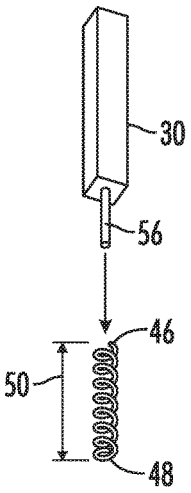
FIG. 17 illustrates an exploded isometric view of the spring attachment mechanism shown in FIG. 16.

Optionally, the compressible sitting stool 10 may further include a base/false bottom 40 located in the housing interior 14 above the housing bottom 16, the base 40 located below and supporting the compressible layer 24, as best seen in FIGS. 4 and 10. Optionally, the base 40 is in the form of a lattice, as best seen in FIGS. 4 and 10. Optionally, the base 40 extends across substantially the entire width 22 of the housing 12, as best seen in FIGS. 4 and 10. If springs are used, the spring bottoms 48 may be attached to the base 40 to prevent theft. Optionally, the compressible layer 24 extends substantially across the entire width 22 of the housing 12, as best seen in FIGS. 1-5, 11, and 18. For example, in a non-limiting example, the base 40 is made of expanded metal (sometimes referred to as metal mesh) to provide a strong but light weight surface for the compressible layer 24 to rest on. The nature of the expanded metal offers a very subtle spring action. Optionally, the base 40 is located from about 6 inches to about 2 feet above the housing bottom 16.

Optionally, the compressible sitting stool 10 does not have a back, as shown in FIGS. 1-18.

Optionally, the compressible sitting stool 10 is used in a method that includes a) providing the compressible sitting stool 10, wherein the housing bottom 16 is located on a surface (e.g., the ground) and wherein the compressible sitting stool 10 is in the relaxed state; and b) sitting on the sitting area 38 so that the compressible sitting stool 10 moves toward the compressed state, as shown in FIG. 8. (It will be understood that only the dowel tops 34 on which the human 52 or object (e.g., human hand 54 as shown in FIG. 9) rests will be depressed and the dowel tops 34 may be depressed unevenly, as shown in FIGS. 8 and 9, because the object or human's weight may be unevenly distributed among the dowel tops 34).

| Part List | |
|---|---|
| Stool | 10 |
| Housing | 12 |
| housing interior | 14 |
| housing bottom | 16 |
| housing top | 18 |
| housing height | 20 |
| housing width | 22 |
| compressible layer | 24 |
| compressible layer height | 26 |
| compressible layer width | 28 |
| dowels | 30 |
| dowel bottom | 32 |
| dowel top | 34 |
| dowel height | 36 |
| sitting area | 38 |
| base | 40 |
| gap | 41 |
| dowel width | 42 |
| compressible layer top | 44 |
| spring top | 46 |
| spring bottom | 48 |
| spring height | 50 |
| outline of a person | 52 |
| outline of a hand | 54 |
| spring fastener | 56 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

What is claimed is:

1. A compressible sitting stool comprising:

a) a housing comprising an interior, a bottom, a top, a height extending from the bottom to the top, and a width generally perpendicular to the height;

b) a compressible layer disposed in the housing interior, the compressible layer comprised of upholstered foam, the compressible layer having a compressible layer height generally parallel to the housing height and a compressible layer width generally parallel to the housing width;

c) a plurality of dowels located above the compressible layer, each dowel comprising a dowel bottom facing the compressible layer, a dowel top located above the dowel bottom, a dowel height extending from the dowel bottom to the dowel top and generally parallel to the housing height, and a dowel width generally parallel to the housing width; and d) a base located in the housing interior, the base located below and supporting the compressible layer, and further wherein the base is in the form of a perforated metal and is located above the housing bottom, wherein the tops of the plurality of dowels form a sitting area, wherein the compressible sitting stool has a relaxed state in which the plurality of dowels do not compress the compressible material, wherein the compressible sitting stool has a compressed state in which at least a portion of the sitting area is lower as compared to the relaxed state, in which at least some of the plurality of dowels compress at least a portion of the compressible layer and in which at least some of the dowel bottoms are closer to the housing bottom as compared to the relaxed state, wherein the height of at least a portion of the compressible layer is less in the compressed state as compared to the relaxed state, and further wherein the compressible sitting stool is configured to move from the relaxed state toward the compressed state when a human sits on the sitting area.

2. The compressible sitting stool of claim 1, wherein the base extends across the entire width of the housing.

3. The compressible sitting stool of claim 1 wherein the plurality of dowels, the sitting area and the housing are generally rectangular.

4. The compressible sitting stool of claim 1, wherein the plurality of dowels are not attached to each other.

5. The compressible sitting stool of claim 1 wherein the tops of the plurality of dowels are co-planar in the relaxed state.

6. The compressible sitting stool of claim 1, wherein each dowel is comprised of wood.

7. The compressible sitting stool of claim 1 wherein the tops of the plurality of dowels form a continuous and flat sitting area in the relaxed state.

8. The compressible sitting stool of claim 1, wherein the bottom of each dowel is not attached to the compressible layer.

9. The compressible sitting stool of claim 1 wherein the compressible layer extends across the entire width of the housing.

10. The compressible sitting stool of claim 1, wherein the compressible layer has the same shape as the housing and is in the form of a foam block.

11. The compressible sitting stool of claim 10, wherein the foam is an open-cell foam.

12. The compressible sitting stool of claim 1, wherein the housing is generally rectangular in shape and is comprised of four opaque walls extending from the housing bottom.

13. A method of using the compressible sitting stool of claim 1, comprising:

a) providing the compressible sitting stool of claim 1, wherein the housing bottom is located on a surface and wherein the compressible sitting stool is in the relaxed state; and b) sitting on the sitting area so that the compressible sitting stool moves toward the compressed state.

* * * * *